US012637874B2

(12) United States Patent
Afshari

(10) Patent No.: US 12,637,874 B2
(45) Date of Patent: May 26, 2026

(54) POST FOOTING NECK FORM A AND B (PFNFormab)

(71) Applicant: Adam Ata Afshari, Woodland Hills, CA (US)

(72) Inventor: Adam Ata Afshari, Woodland Hills, CA (US)

( * ) Notice: Subject to any disclaimer, the term of this patent is extended or adjusted under 35 U.S.C. 154(b) by 347 days.

(21) Appl. No.: 17/394,387

(22) Filed: Aug. 4, 2021

(65) Prior Publication Data

US 2024/0384555 A1 Nov. 21, 2024

(51) Int. Cl.
*E04H 12/22* (2006.01)

(52) U.S. Cl.
CPC ..... *E04H 12/22* (2013.01)

(58) Field of Classification Search
CPC ..... E02D 5/44; E04G 13/02; E04G 13/021; E04G 13/028; E04G 11/46; E04H 12/22; E04H 12/224; E04H 12/2238; E04H 12/2253; E04H 12/2269; E04H 12/2292; E04D 13/1476; E04D 13/1473; E04D 13/1407; E04D 13/1415
See application file for complete search history.

(56) References Cited

U.S. PATENT DOCUMENTS 5,271,203 A * 12/1993 Nagle ..... E04H 12/2269 52/294
5,800,727 A * 9/1998 Croghan ..... E04G 13/028 249/48
5,901,525 A * 5/1999 Doeringer ..... E04H 12/2253 52/298
6,691,473 B1 * 2/2004 Mayle ..... E04D 13/1407 52/96
6,840,491 B2 * 1/2005 Swinimer ..... E02D 27/42 249/48
7,981,330 B2 * 7/2011 Jensen ..... E02D 29/02 264/31
2005/0102925 A1 * 5/2005 Boyd ..... E04H 12/2269 52/169.9

(Continued)

*Primary Examiner* — Theodore V Adamos

(57) ABSTRACT

Post Footing Neck Forms (A & B) are inexpensive plastic forms to be used at the final stage of concrete pouring for posts by placing them on the top section of the hole, thus creating a clean and round concrete surface at the top around the post respective to the dirt and ground level, which is aesthetically more pleasing. After curing the concrete, the form does not necessarily need to be removed.

This invention has 2 variations (Form A & B) to address different situations and needs. Form A is a plastic half-cone shell with no cut or split line on any side, with horizontal stabilizer flange at the bottom that allows position and adjusts the form on the freshly poured concrete more easily. Form B is a plastic half-cone shell with cut on one side, including locking cuts and tongues as a locking mechanism to connect the ends of the plastic form together without the use of taping, in order to be able to place the form around the post even after securing the holding braces. Horizontal stabilizer flanges at the bottom also allow positioning and adjusting Form B on the freshly poured concrete more easily.

These forms have been designed principally to form concrete around posts. However, they could be used for other applications as well.

The present invention can be better understood from the following drawings and their descriptions.

1 Claim, 3 Drawing Sheets

(56) References Cited

U.S. PATENT DOCUMENTS

2007/0138452 A1* 6/2007 Donabedian ..... E04H 12/2292
256/1
2007/0157528 A1* 7/2007 Gawoski ..... E06B 1/62
52/58

* cited by examiner

POST FOOTING NECK FORM A AND B (PFNFormab)

| References Cited: | | |
|---|---|---|
| U.S. Patent Documents | | |
| 4,673,157 | June 1987 | Gordon T. Wells |
| 5,785,459 | July 1998 | Kirk Swinimer |
| 5,800,727 | September 1998 | Morris T. Croghan |
| 6,840,491 B2 | January 2005 | Kirk Swinimer |
| 723,064 | March 1903 | Stoner |
| 822,814 | June 1906 | Baker |
| 986,957 | March 1911 | Wallin |
| 1,211,133 | January 1917 | Geiger |
| 1,428,953 | September 1922 | Garlinghouse |
| 2,448,883 | September 1948 | Hall |
| 3,301,926 | January 1967 | Reiland |
| 3,488,027 | January 1970 | Evans |
| 3,632,078 | January 1972 | Dashew |
| 1,296,995 | March 1919 | Miller |
| 3,108,403 | October 1963 | Jackson |
| 3,159,899 | December 1964 | Pafenberg |
| 3,159,900 | December 1964 | Pafenberg |
| 4,648,220 | March 1987 | Gebelius |
| 4,830,543 | May 1989 | Joubert |
| 4,673,157 A | June 1987 | Wells |
| 5,271,203 A | December 1993 | Nagle |
| 5,785,459 A | July 1998 | Swinimer |
| 5,800,727 A | September 1998 | Croghan |
| 6,543,742 B2 | April 2003 | Wells |
| Foreign Patent Documents | | |
| 3215579 | October 1983 | Fed. Rep. of Germany |
| 150359 | August 1981 | German Democratic Rep. |
| 130634 | August 1982 | Japan |
| 181424 | June 1922 | United Kingdom |

BACKGROUND AND DESCRIPTION OF INVENTION

In the summer of 2019 when I was planning to replace a portion of my house perimeter fence on a hillside, I noticed that earth burrowing and digging and installation of posts was a major effort. Digging a post hole in the dirt area could be challenging, and the top part of the hole almost never ends up a perfectly round shape. Therefore, I had a hard time shaping the concrete nice and round at the surface level. I looked on the internet and in the market, and also researched the registered inventions in this category, but could not find any forms that I could utilize. As a result, for a hole that I could not manage the concrete pouring without using a form, I had to cut and modify an empty plastic paint bucket to achieve my objective.

My invention, Post Footing Neck Form A or B, which is a plastic half-cone shell with or without cut or split line on the side, as shown and outlined in this document, can achieve all of my objectives and help form a clean and round concrete surface around the installed post.

After setting the post in the hole, and before attaching the temporary holding braces and pouring concrete, Form A needs to go in around the post from the top and be initially clipped to it at a level that is not an obstacle to pouring concrete. Then after adjusting the post and attaching the braces, pouring concrete can be started. Pouring concrete should be stopped before reaching the ground level, allowing for the height of the Form. Then the form has to be unclipped, lowered, positioned and adjusted at the right level around the post, and then concrete is poured inside the form up to the edge. After curing the concrete, the Form does not need to be removed and the space around the form can be backfilled using the excavated dirt and compacted.

The process for using Form B is basically the same, except that the Form does not need to be in and clipped to the post before attaching the braces, and can be positioned in place at the last stage of concrete pouring, and the two ends are then attached and locked in together. Therefore, if the temporary holding braces are already attached, Form B could be more appropriate since detaching of braces can be avoided.

DESCRIPTION OF THE DRAWINGS

The various embodiments and variations thereof conceptually illustrated in the accompanying Figures and/or described herein are merely exemplary and are not meant to limit the scope of the invention. It is to be appreciated that numerous variations of the invention could be contemplated as would be obvious to one of ordinary skill in the art with the benefit of this disclosure.

FIG. 1 is comprising: metal or wooden post 1, concrete 2, plastic half-cone shell 3 [About 1/32 inch thick and made from thin plastic such as polypropylene (PP), polystyrene (PS), polyethylene terephthalate (PETE), PET, high density polyethylene (HDPE) or biodegradable plastic/bioplastics, such as polylactic acid, Bio-PP, and Bio-PET], horizontal stabilizer flange 4, ground level 5, original soil around the dug up post hole 6, compacted backfill soil after curing concrete 7.

FIG. 2 is comprising: metal or wooden post 1, concrete 2, plastic half-cone shell with inward and outward tongues and locking cuts 3 for a tonguing and tucking system, as a locking mechanism to close the vertical split line and to hold the shape of the form [about 1/32 inch thick and made from thin plastic such as Polypropylene (PP), Polystyrene (PS), Polyethylene terephthalate (PETE), PET, High density polyethylene (HDPE) or Biodegradable Plastic/bioplastics; such as Polylactic acid, Bio-PP, and Bio-PET], horizontal stabilizer flanges 4, ground level 5, original soil around the dug up post hole 6, compacted backfill soil after curing concrete 7, horizontal stabilizer flange cuts 8, locking cuts 9, locking inward tongue 10, locking outward tongue 11, split edge line 12.

FIG. 3 is comprising: a flat plastic half-cone shell (in flattened form) with locking cuts 3 [about 1/32 inch thick and made from thin plastic such as Polypropylene (PP), Polystyrene (PS), Polyethylene terephthalate (PETE), PET, High density polyethylene (HDPE) or Biodegradable Plastic/bioplastics; such as Polylactic acid, Bio-PP, and Bio-PET], horizontal stabilizer flanges 4, horizontal stabilizer flange cuts 8, locking cuts 9, locking inward tongue 10, locking outward tongue 11, split edge line 12.

Figure 1:
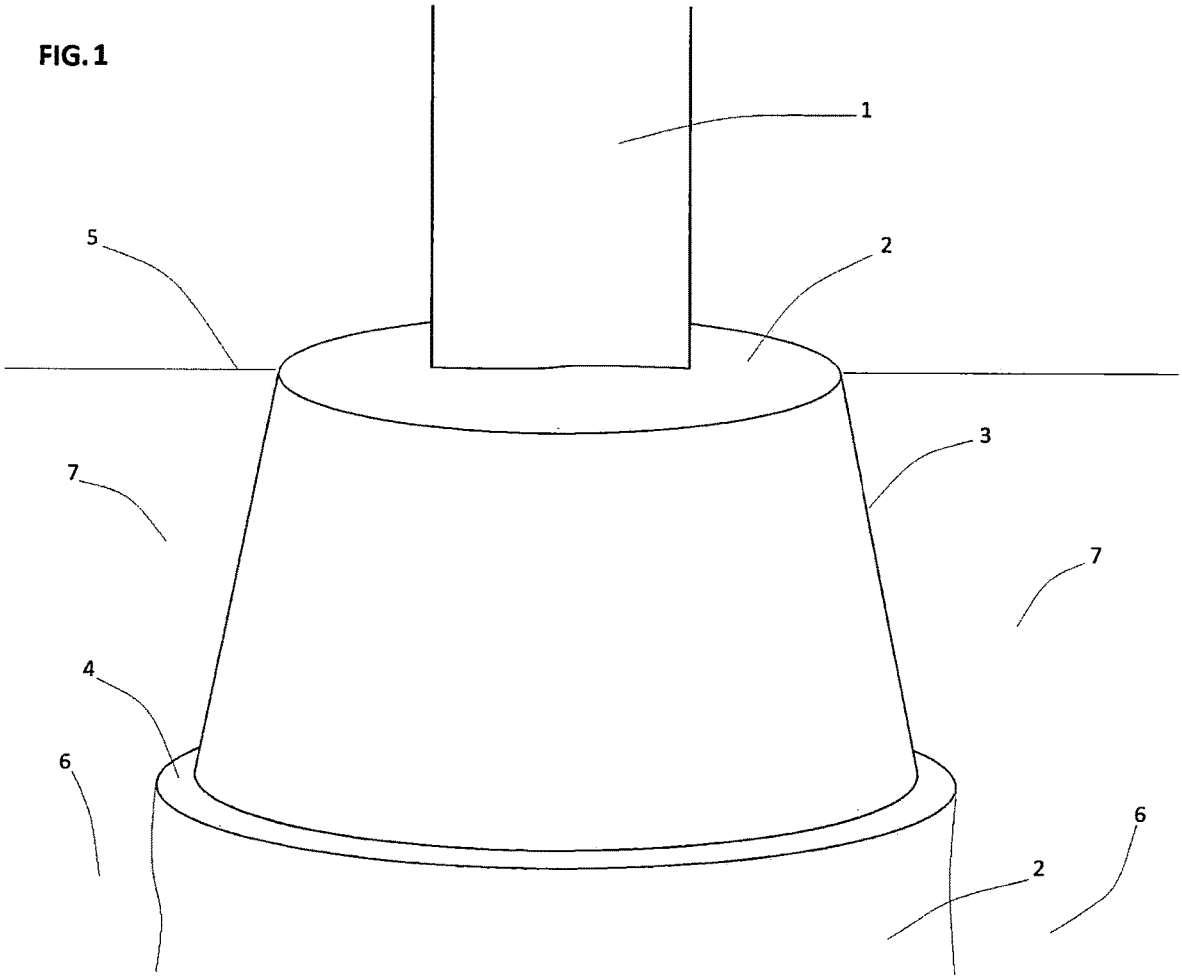
FIG. 1 is a conceptual perspective view of Form A—It shows the overall configuration of the Form with respect to the post, concrete and ground level. For simplicity, some details are not shown.
Figure 2:
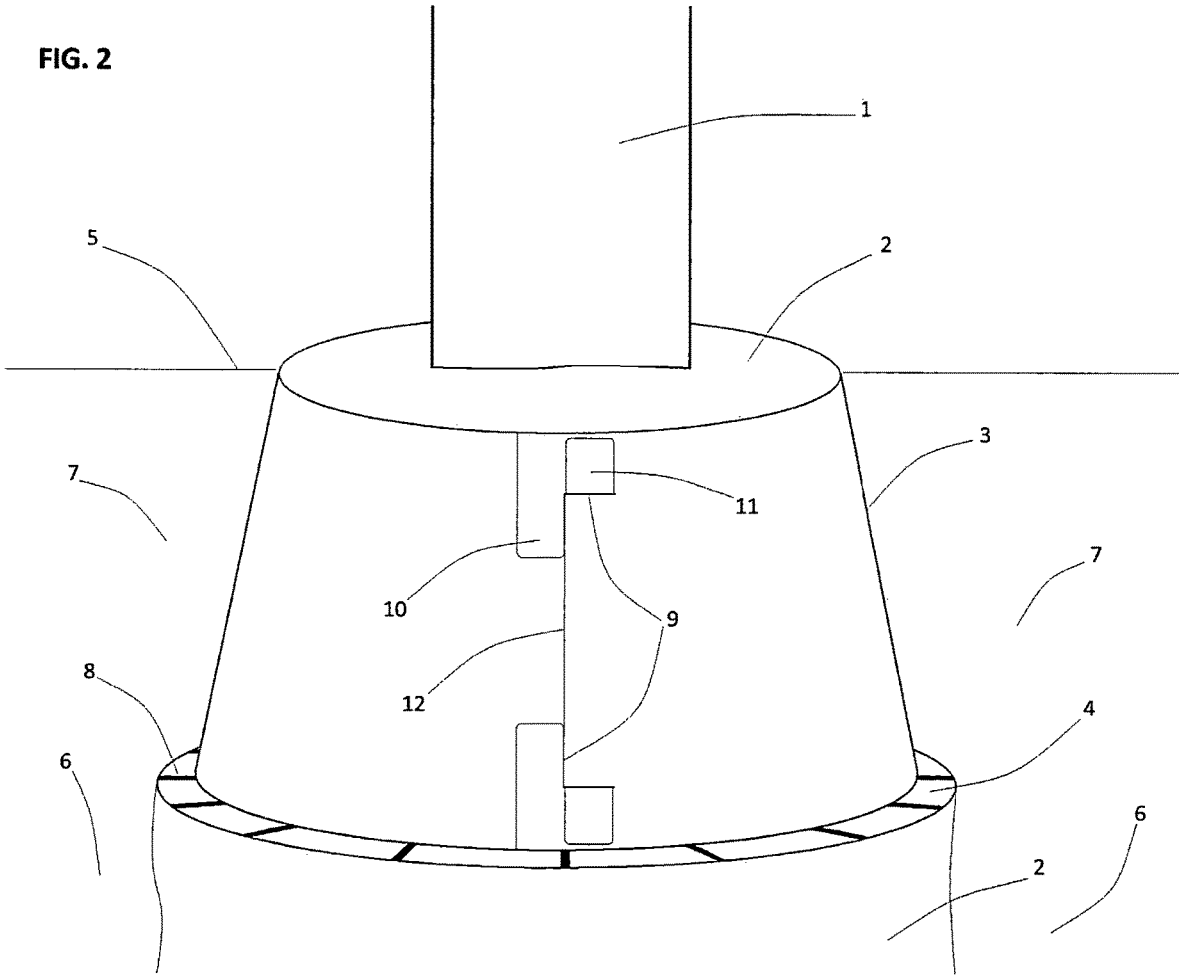
FIG. 2 is a conceptual perspective view of Form B—It shows the overall configuration of the Form with respect to the post, concrete and ground level. For simplicity, some details are not shown.
Figure 3:
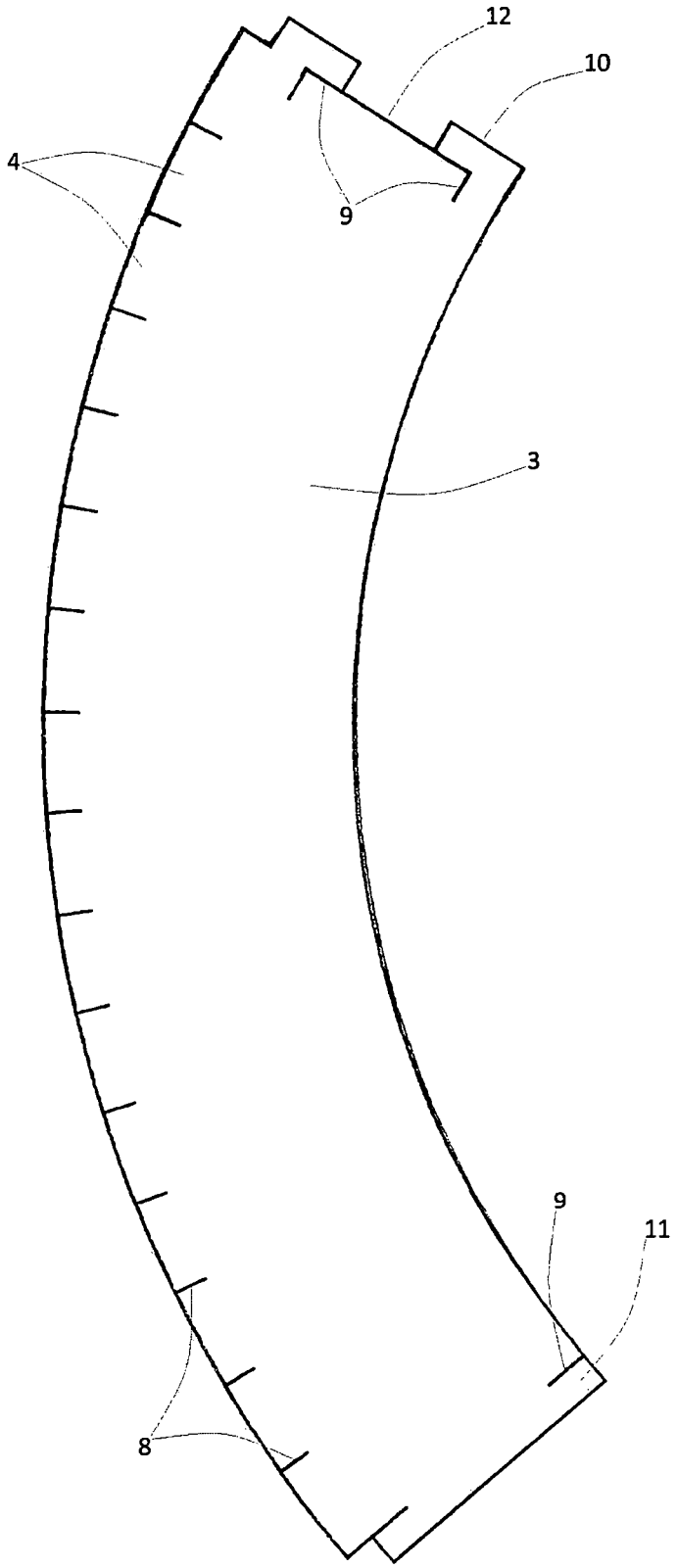
FIG. 3 is a conceptual flat view of the Form B—For simplicity, some details are not shown.

What is claimed is:

1. A post footing neck form for use as an in-ground concrete form for fence posts in dirt that is splitable in order to be placed around a fence post and removed therefrom, the post footing neck form comprising:

a smooth, thin piece of plastic configured to be formed into a hollow, truncated cone shell, the smooth, thin piece of plastic comprising opposing first and second longitudinal free ends and a tonguing and tucking mechanism formed on such free ends, wherein the smooth, thin piece of plastic is about 1/32 inch thick;

wherein the plastic comprising one of polypropylene (PP), polystyrene (PS), polyethylene terephthalate (PETE), PET, high density polyethylene (HDPE), polylactic acid, BIO-PP, or BIO-PET;

wherein a bottom edge of the smooth, thin piece of plastic further comprises a plurality of annular outward flanges connected along the bottom edge with a gap between adjacent annular outward flanges formed by a cut within the smooth, thin piece of plastic, the annular outward flanges configured to bend relative to the bottom edge in order to form a horizontal stabilizer assembly which the smooth, thin piece of plastic extends upwardly from;

wherein the tonguing and tucking mechanism comprises first and second locking cuts at the first free end, the first locking cut extending from a top edge of the smooth, thin piece of plastic towards a center of the smooth, thin piece of plastic, the second locking cut extending from the bottom edge to the center of the smooth, thin piece of plastic, the first and second locking cuts forming respective first and second outward tongues at the first free end;

wherein the tonguing and tucking mechanism further comprises third and fourth locking cuts in the second free end, the third and fourth locking cuts forming first and second inward tongues and a split edge tab therebetween, the first and second inward tongues each being L-shaped and formed in a top and bottom, respectively, of the second free end, the first and second inward tongues spaced from one another by a gap, wherein the first and second inward tongues project farther outward along the free edge than the split edge tab;

wherein the first outward tongue is configured to be inserted into the third locking cut so as to be positioned behind the split edge tab and over the first inward tongue and the second outward tongue is configured to be inserted into the fourth locking cut so as to be positioned behind the split edge tab and over the second inward tongue in order to releasably hold the truncated cone shape of the smooth, thin piece of plastic.

* * * * *